US009340888B2

(12) United States Patent
Kurrle

(10) Patent No.: US 9,340,888 B2
(45) Date of Patent: May 17, 2016

(54) ELECTROLYTIC BATH FOR ELECTRODEPOSITION AND METHOD FOR PRODUCING SAME

(71) Applicant: IPT International Plating Technologies GmbH, Stuttgart (DE)

(72) Inventor: Matthias Kurrle, Stuttgart (DE)

(73) Assignee: IPT INTERNATIONAL PLATING TECHNOLOGIES GMBH, Stuttgard (DE)

( * ) Notice: Subject to any disclaimer, the term of this patent is extended or adjusted under 35 U.S.C. 154(b) by 0 days.

(21) Appl. No.: 13/779,148

(22) Filed: Feb. 27, 2013

(65) Prior Publication Data

US 2013/0168259 A1 Jul. 4, 2013

Related U.S. Application Data

(63) Continuation of application No. PCT/EP2011/004244, filed on Aug. 24, 2011.

(30) Foreign Application Priority Data

Aug. 27, 2010 (DE) ..... 10 2010 035 661

(51) Int. Cl.

| | |
|---|---|
| ***C25D 3/56*** | (2006.01) |
| ***C25D 3/16*** | (2006.01) |
| ***C23C 18/36*** | (2006.01) |
| ***C25D 3/12*** | (2006.01) |

(52) U.S. Cl.
CPC . *C25D 3/12* (2013.01); *C25D 3/562* (2013.01)

(58) Field of Classification Search
CPC ..... C25D 3/12; C25D 3/562; C25D 11/36; C23C 18/36
USPC ..... 205/258, 259, 271; 106/1.27
See application file for complete search history.

(56) References Cited

U.S. PATENT DOCUMENTS

| | | | | | |
|---|---|---|---|---|---|
| 2,643,221 | A * | 6/1953 | Brenner et al. | ..... | 205/258 |
| 3,355,267 | A * | 11/1967 | Du Rose | ..... | 428/639 |
| 4,673,468 | A * | 6/1987 | Myers et al. | ..... | 205/101 |
| 4,767,509 | A | 8/1988 | Gamblin et al. | | |
| 6,099,624 | A * | 8/2000 | Martyak | ..... | 106/1.27 |
| 2004/0201446 | A1 * | 10/2004 | Matsuda et al. | ..... | 338/308 |

FOREIGN PATENT DOCUMENTS

| | | | | | |
|---|---|---|---|---|---|
| EP | 0 925 388 | B1 | 10/2002 | | |
| KR | 1020050028449 | A * | 3/2005 | ..... | C25D 3/12 |
| WO | WO 99/02765 | | 1/1999 | | |
| WO | WO 02/063070 | A1 | 8/2002 | | |

OTHER PUBLICATIONS

International Search Report Mailed Nov. 4, 2011 issued in connection with International Application PCT/EP2011/004244 (3 pages).
English language translation of KR-20050028449-A provided by the European Patent Office (10 pages).

* cited by examiner

*Primary Examiner* — Edna Wong
(74) *Attorney, Agent, or Firm* — Robert P. Michal, Esq.; Carter, DeLuca, Farrell & Schmidt LLP

(57) ABSTRACT

An electrolytic bath for electrodeposition includes nickel salt, phosphoric acid, phosphonic acid, and boric acid in solution. A method for producing an electrolytic bath includes the steps of mixing a nickel salt, phosphoric acid, phosphonic acid, and boric acid, and adding nickel carbonate in order to increase the pH value.

4 Claims, No Drawings

ELECTROLYTIC BATH FOR ELECTRODEPOSITION AND METHOD FOR PRODUCING SAME

CROSS-REFERENCE TO RELATED APPLICATIONS

This is a Continuation of PCT International Application PCT/EP2011/004244 filed Aug. 24, 2011, which in turn claims priority of German Application No. DE 10 2010 035 661.1 filed Aug. 27, 2010, the entire contents of each of which is incorporated herein by reference.

FIELD OF THE INVENTION

The invention relates to an electrolytic bath for electrodeposition and to a method for producing it, more particularly for electrodeposition of a nickel-phosphorus layer.

BACKGROUND INFORMATION

Electrodepositing a nickel-phosphorus layer (NiP layer) onto substrates is of advantage for numerous applications, since an NiP layer is very hard and has good antiwear properties. In addition to nickel electroplating, chemical nickelization is known as well.

An electrolytic bath permits preferably high-quality coating with a high current density and deposition rate, and is as cost-effective as possible.

It is an object of the invention to provide a new electrolytic bath for electrodeposition, and a method for producing it.

SUMMARY

In accordance with the invention, the object is achieved by an electrolytic bath and a method. An electrolytic bath of this kind is stable, permits a high current density, high deposition rate, and production of a good nickel-phosphorus layer, and is cost-effective. Saccharine is preferably added during the method.

Further details and advantageous developments of the invention will emerge from the working examples which are described below, and which should in no way be understood as any restriction on the invention, and also from the dependent claims.

DETAILED DESCRIPTION

A typical electroplating line has a trough containing a bath (electrolyte, electroplating bath). The substrate for coating (e.g., cylinder liner of an engine block) is surrounded in the electrolyte and by a dimensionally stable, insoluble anode or by a soluble anode. A direct-current source is connected by the positive terminal to the anode and by the negative terminal to the substrate (cathode), and the layer is electrodeposited on the substrate by the current. A circulation pump ensures uniform distribution of the bath, and the substrate may be rotated in the electrolyte. This is only an elucidating example, and other electroplating lines can also be used.

The composition of the bath determines parameters including the current densities and hence deposition rates that are possible in the context of coating, and baths for numerous end uses are available on the market.

Composition of the NiP Bath

A bath is proposed which is highly suitable for electrocoating with a layer of nickel and phosphorus and optionally further constituents, and so the bath is referred to below as NiP bath. As compared with a pure nickel coating, a nickel-phosphorus coating has greater hardness and hence allows access to additional areas of application. The nickel fraction in the nickel-phosphorus layer also has an influence on the antiwear properties and the corrosion properties of the alloy. The phosphorus content of the layer determines the hardness, and a customary mass fraction is, for example, 6-8 wt. % phosphorus, although depending on the requirements it is also possible that higher mass fractions, of 12 wt. %, for example, may be required.

Preference is given to using an NiP bath with a composition including in solution:

nickel salt
phosphoric acid ($H_3PO_4$)
phosphonic acid ($H_3PO_3$)
boric acid ($H_3BO_3$)

The nickel, or more specifically the nickel ions, are present in the solution predominantly in the form of nickel(II) or $Ni^{2+}$, although other oxidation states may also occur.

In addition, the NiP bath may also include saccharine and/or further additives. The addition of $H_3PO_2$ (phosphonic acid) is likewise possible, but did not lead to any better outcome in the experiments.

The combination of the phosphoric acid, phosphonic acid, and boric acid constituents has proven advantageous, since the complete bath with this combination has proven relatively stable, particularly in relation to pH. The combination also allows a high current density and hence a high deposition rate. Furthermore, the constituents are relatively cost-effective.

The pH of the completed bath preparation is preferably in the range from 1.6 to 2.3, more preferably in the range from 1.8 to 2.2.

Indicated below are preferred range figures for the individual constituents of the composition, with which the electrolytic deposition functions well (high deposition rate and good-quality nickel-phosphorus layer) and where the phosphorus content in the deposited layer matches the requirements:

nickel(II): 90-130 g/l
phosphoric acid: 60-90 g/l
phosphonic acid: 20-40 g/l
boric acid: 30-40 g/l
saccharine: 0-4 g/l Since the constituents in the (aqueous) solution are partly dissociated, other range figures are better to be verified for measuring the concentration of the constituents.

The nickel salt is added preferably in the form of nickel sulfate in aqueous solution ($NiSO_4.6H_2O$ or nickel(II) sulfate hexahydrate). The concentration of the sulfate ($SO_4^{2-}$) in this case for the upper range figure of the nickel(II) is as follows:

sulfate: 147-213 g/l

This sulfate concentration range can also be achieved or influenced, for example, by addition of sulfuric acid.

The phosphoric acid and phosphonic acid in the solution are substantially fully disassociated, and so the concentration of phosphoric acid and/or phosphonic acid, in accordance with the above range figures, can also be indicated via the concentration of the phosphate ($PO_4^{3-}$) and/or phosphite ($PO_3^{3-}$):

phosphate: 58-88 g/l
phosphite: 19-39 g/l

The boric acid is incompletely disassociated in the solution. Dissolved molecules ($H_3BO_3$) are therefore in an equilibrium with ions ($3\ H^+ + BO_3^{3-}$). A bath in accordance with the above range figures for the boric acid concentration comprises boron (partly as a constituent of the borate and partly as a constituent of the boric acid) with a concentration in the range from 5.2 to 7.0 g/l.

The NiP bath can be used to coat various substrates. For example, copper, steel, or stainless steel may be coated. Coating is preferably preceded by degreasing, activating, and pickling of the substrate, as the skilled person is aware.

Experiments Conducted

A multiplicity of experiments were conducted with different bath compositions for the deposition of NiP. With the experiments set out by way of example below, it was possible, through electrodeposition, to produce an NiP layer. The deposited NiP layer was pore-free, homogeneous, and amorphous, and had a charcoal-gray luster, with recrystallization being possible by heating. The substrate used was a copper bolt, which was pretreated (degreasing, activating, and pickling). The temperature was about 65° C., and the current density was up to 30 A/dm$^2$. The deposition rate is dependent on the current density, and typical deposition rates of 0.5 μm/min to more than 2 μm/min were obtained; these figures do not constitute technical limits. Successful experiments were conducted with layer thicknesses of up to 100 μm.

Examples I to V

The composition of the NiP bath was as follows:

| Experiment | Nickel(II) | Phosphoric acid | Phosphonic acid | Boric acid | Saccharine |
|---|---|---|---|---|---|
| I | 100 g/l | 75 g/l | 30 g/l | 35 g/l | 2.6 g/l |
| II | 100 g/l | 75 g/l | 30 g/l | 35 g/l | 0 g/l |
| III | 100 g/l | 75 g/l | 40 g/l | 30 g/l | 2.6 g/l |
| IV | 100 g/l | 60 g/l | 30 g/l | 30 g/l | 2.6 g/l |
| V | 100 g/l | 45 g/l | 10 g/l | 30 g/l | 2.6 g/l |

The concentration of the phosphoric acid and phosphonic acid can also be stated via the concentration of the phosphate ($PO_4^{3-}$) or phosphite ($PO_3^{3-}$), respectively. Thus, for example, 75 g/l phosphoric acid corresponds to a value of 73 g/l phosphate, and 30 g/l phosphonic acid corresponds to a value of 29 g/l phosphite.

At NiP layer thicknesses of 5-10 μm for example, the use of saccharine is unnecessary, but has proven advantageous especially for layer thicknesses of more than 40 μm.

Electrodeposition operates well, for example, at a temperature of about 65° C. Higher temperatures of 80-90° C., for example, are also possible; when using organic adjuvants such as saccharine, for example, account must be taken of their temperature sensitivity.

Coating was carried out reproducibly at current densities of up to 30 A/dm$^2$. The current yield measured was approximately 50-55%. With a current density of 10 A/dm$^2$, a deposition rate of about 1 μm/min was achieved.

In the case of the experiments conducted, the glass fraction of phosphorus measured in the nickel-phosphorus layer was up to 12 wt. %.

The experiment showed that a higher concentration of nickel(II) in the bath permits a higher current density, with the concentration being limited by the saturation limit.

A layer of NiP is a binary alloy with the constituents Ni and P. Further constituents for deposition, however, may also be added to the NiP bath. It is possible accordingly, for example, to deposit a ternary (Ni—X—P, e.g., Ni—Co—P) or quaternary alloy as well, or else the deposition of a dispersion layer is possible in which additional particles are embedded in the NiP layer, examples being silicon carbide (SiC), boron nitride (BN), boron carbide ($B_4C$), titanium nitride (TiN), silicon nitride ($Si_3N_4$), titanium carbide (TiC), tungsten carbide (WC) and/or aluminum oxide ($Al_2O_3$).

Analysis of the NiP Bath

A requirement for commercial electrocoating is the possibility of analysis of the bath composition. While the concentration of nickel(II) can be measured via titration, and while the concentration of the phosphoric acid and the phosphonic acid is possible via measurement of the concentration of the phosphate ($PO_4^{3-}$) and phosphite ($PO_3^{3-}$), respectively, by means of ion chromatography, the determination of the concentration of boric acid in the stated NiP bath is more difficult or more complicated. Since a titration for determining the concentration of the boric acid is impossible or difficult, owing to the similar pKa values for boric acid, phosphoric acid, and phosphonic acid, the boric acid concentration has to be determined using other methods, such as via AAS (atomic absorption spectrometry), for example, or, for precise measurements, via the relatively expensive ICP-OES (optical emission spectrometry with inductively coupled plasma).

Production of the NiP Bath

Example VI

As an example, the production of an NiP bath having the following composition is described:

100 g/l $Ni^{2+}$
64 g/l $H_3PO_4$
30 g/l $H_3PO_3$
35 g/l $H_3BO_3$
2.6 g/l saccharine
pH=1.8

Step 1

The first step involves, in the case of the optional addition of saccharine, mixing:

425.4 g/l nickel(II) sulfate hexahydrate in aqueous solution
2.6 g/l saccharine

The nickel(II) sulfate hexahydrate ($NiSO_4.6H_2O$) in aqueous solution is available, for example, from IPT International Plating Technologies GmbH, Stuttgart, as NDC Make Up & Maintenance. This is a nickel(II) sulfate hexahydrate solution having a nickel concentration of 114.5 g/l. For the above-indicated amount of nickel(II) sulfate hexahydrate it is necessary to add 0.675 l of NDC Make Up & Maintenance. The stated amount leads to a concentration of approximately 95 g/l nickel(II).

Step 2

In the second step the bath is admixed with:

44 ml/l 85% strength phosphoric acid
30 g/l phosphonic acid
35 g/l boric acid

The phosphonic acid and the boric acid are solids, which can be added as they are or else in solution. The bath in this state has a pH in the region of below 1. If saccharine is added, it is added preferably to the nickel salt solution and before the addition of the acids.

Step 3

Subsequently, in the third step or in the first and/or second step, nickel carbonate ($NiCO_3$) is added until the pH has risen approximately to 1.8. This can be done, for example, by continually measuring the pH during the addition of the nickel carbonate, and halting the addition as soon as the desired pH is reached. In this way, on the one hand, an additional nickel is supplied (approximately 5 g/l $Ni^{2+}$) and, on the other hand, the increased pH significantly increases the current yield. Raising the pH by adding nickel carbonate functions well up to a pH of around 2.2. At a higher pH, saturation may occur in the bath.

The pH is increased in accordance with the following reaction equation:

$$2\,H^{+}+NiCO_3 \rightarrow CO_2\uparrow+H_2O+Ni^{2+}$$

The carbon dioxide ($CO_2$) escapes as a gas.

Increasing the pH can also be accomplished, for example, by adding aqueous alkalis (e.g., sodium hydroxide (NaOH)). An advantage of using nickel carbonate to raise the pH is that no cations of additional elements enter the bath, but the concentration of nickel(II), possibly lowered as a result of the electrodeposition, is increased again.

Step 4

In the fourth step or in the first, second and/or third step, the electrolytic bath is made up to the desired volume with DI water (fully deionized water).

Production of the NiP bath operates well, for example, at a temperature of around 40-65° C.; these are not absolute limits.

Diverse modifications and adaptations are of course possible within the scope of the present invention.

For example, different nickel salts and combinations of nickel salts are also possible (e.g., nickel sulfate and nickel chloride ($NiCl_2$)), with preferably at least 50% of the nickel (ii) in the production of the bath coming from the nickel sulfate, more preferably at least 70%.

A further increase in hardness can be achieved by heat-treating (heating) the coated substrate.

Many modifications and other embodiments of the inventions set forth herein will come to mind to one skilled in the art to which these inventions pertain having the benefit of the teachings presented in the foregoing descriptions. Therefore, it is to be understood that the inventions are not to be limited to the specific embodiments disclosed and that modifications and other embodiments are intended to be included within the scope of the appended claims. Moreover, although the foregoing descriptions describe example embodiments in the context of certain example combinations of elements and/or functions, it should be appreciated that different combinations of elements and/or functions may be provided by alternative embodiments without departing form the scope of the appended claims. In this regard, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. An electrolytic bath for electrodeposition, comprising in a solution:

a) nickel sulfate:

b) phosphoric acid with a concentration in the range of 60-90 g/l;

c) phosphonic acid with a concentration in the range of 20-40 g/l; and d) boric acid, wherein a concentration of sulfate in the electrolytic bath is in the range of 147-213 g/l, wherein a concentration of nickel (II) in the electrolytic bath is in the range of 90-130 g/l;

wherein the pH of the electrolytic bath is in the range from 1.6 to 2.3; and wherein the electrolytic bath does not comprise nickel chloride.

2. The electrolytic bath of claim 1, wherein in the solution the boric acid has a concentration in the range of 30-40 g/l.

3. The electrolytic bath of claim 1, further comprising in the solution 0-4 g/l of saccharine.

4. The electrolytic bath of claim 1, wherein more than 50%, of the nickel(II) in the bath comes from the nickel sulfate.

* * * * *